US010947079B2

(12) United States Patent
Fjetland

(10) Patent No.: US 10,947,079 B2
(45) Date of Patent: Mar. 16, 2021

(54) CABLE DRUM FEEDING TOOL FOR A VEHICLE WITH A LIFTING DEVICE

(71) Applicant: Jack-Pack AS, Sandnes (NO)

(72) Inventor: Geir Tore Fjetland, Sandnes (NO)

(73) Assignee: Jack-Pack AS, Sandnes (NO)

( * ) Notice: Subject to any disclaimer, the term of this patent is extended or adjusted under 35 U.S.C. 154(b) by 207 days.

(21) Appl. No.: 16/324,212

(22) PCT Filed: Aug. 23, 2017

(86) PCT No.: PCT/NO2017/050209
§ 371 (c)(1),
(2) Date: Feb. 8, 2019

(87) PCT Pub. No.: WO2018/038620
PCT Pub. Date: Mar. 1, 2018

(65) Prior Publication Data

US 2019/0168987 A1 Jun. 6, 2019

(30) Foreign Application Priority Data

Aug. 25, 2016 (NO) ..... 20161355

(51) Int. Cl.
*B65H 49/34* (2006.01)
*B65H 49/26* (2006.01)
(Continued)

(52) U.S. Cl.
CPC ..... *B65H 49/34* (2013.01); *B65H 49/26* (2013.01); *B65H 49/325* (2013.01); *B65H 75/42* (2013.01); *B65H 75/425* (2013.01)

(58) Field of Classification Search
CPC ..... B65H 49/26; B65H 49/34; B65H 49/325; B65H 75/42; B65H 75/425
See application file for complete search history.

(56) References Cited

U.S. PATENT DOCUMENTS 3,314,622 A 4/1967 McClean et al.
4,130,985 A 12/1978 Varga et al.
(Continued)

FOREIGN PATENT DOCUMENTS

CN 104002720 8/2014
CN 203766587 U 8/2014
(Continued)

OTHER PUBLICATIONS

Norwegian Search Report, Norwegian Patent Application No. 20161355, dated Mar. 24, 2017.
(Continued)

*Primary Examiner* — Sang K Kim
(74) *Attorney, Agent, or Firm* — Andrus Intellectual Property Law, LLP

(57) ABSTRACT

A cable drum feeding tool is for a vehicle with a lifting device. The tool has a primary gripper arm arrangement with a primary first gripper arm and a primary second gripper arm extending parallel and spaced apart from each other via a spacing, and a connection element connecting the primary gripper arms, and a primary gripper arm mechanism for moving at least one of the primary gripper arms. The tool further comprises rotation mechanism having a respective pivot at the primary gripper arms adapted to engage with respective flanges of a cable drum. The tool further has an attachment arrangement for releasably attaching the tool to the lifting device of the vehicle.

19 Claims, 8 Drawing Sheets

(51) Int. Cl.
*B65H 49/32* (2006.01)
*B65H 75/42* (2006.01)

(56) References Cited

U.S. PATENT DOCUMENTS

| | | | | |
|---|---|---|---|---|
| 5,895,197 | A | 4/1999 | McVaugh et al. | |
| 5,897,073 | A * | 4/1999 | McVaugh | B60P 3/035 242/390.5 |
| 5,988,555 | A | 11/1999 | Unruh et al. | |
| 2010/0314482 | A1 * | 12/2010 | Merkt | A01G 20/18 242/557 |
| 2015/0158692 | A1 | 6/2015 | Reynolds et al. | |
| 2015/0217967 | A1 | 8/2015 | Mays et al. | |

FOREIGN PATENT DOCUMENTS

| | | |
|---|---|---|
| SE | 466443 | 2/1992 |
| WO | 2008064166 | 5/2008 |
| WO | 2015128968 | 3/2015 |

OTHER PUBLICATIONS

International Search Report, PCT/NO2017/050209, dated Nov. 3, 2017.
Written Opinion, PCT/NO2017/050209, dated Nov. 3, 2017.

* cited by examiner

CABLE DRUM FEEDING TOOL FOR A VEHICLE WITH A LIFTING DEVICE

CROSS-REFERENCE TO RELATED APPLICATIONS

This application is the U.S. national stage application of International Application PCT/NO2017/050209, filed Aug. 23, 2017, which international application was published on Mar. 1, 2018, as International Publication WO 2018/038620 in the English language. The International Application claims priority of Norwegian Patent Application No. 20161355, filed Aug. 25, 2016. The international application and Norwegian application are both incorporated herein by reference, in entirety.

INTRODUCTION

The present invention relates to a cable drum feeding tool for a vehicle with a lifting device. The vehicle is for example an excavator, a crane, a wheel loader, a forklift, etcetera. The tool comprises a primary gripper arm arrangement comprising a primary first gripper arm and a primary second gripper arm extending parallel and spaced apart from each other by means of a spacing, and a connection element connecting the primary first gripper arm and the primary second gripper arm. The tool further comprises a primary gripper arm mechanism for moving at least one of the primary first gripper arm and the primary second gripper arm towards and away from the other of the primary gripper arms, and a rotation mechanism comprising a respective pivot at the primary first gripper arm and the primary second gripper arm adapted to engage with respective flanges of a cable drum.

PRIOR ART

Prior art tools for handling cable drums comprise an attachment rod that is connected to the lifting device of the vehicle. The attachment rod is inserted into the opening of the cable drum for providing a rotatable attachment of the cable drum. The cable drum is then lifted by the lifting device and the cable drum is manually rotated in the elevated position.

Using such a freely hanging suspension tool, requires a person to control the paying out of cable from the drum and brake the drum's rotation. Furthermore, the person also controls the orientation of the drum. The direct manual involvement constitutes a safety risk, and is highly undesirable from a Health, Safety and Environment perspective. Another disadvantage of these suspension tools is that it is relatively time-consuming to switch from one cable drum to another or between a cable drum and other tools, mainly because of the long shaft that is to be inserted axially through the drum. The long shaft also makes it more or less impossible to switch between different cable drums or between a cable drum and another tool without manual involvement.

SE466443 discloses an automatic cable reel comprising means for vertical and horizontal displacement of tailstock spindles. A problem with the automatic cable reel is an autonomous device that it is not suitable for field conditions, such as the conditions of a construction size.

SUMMARY OF THE INVENTION

The invention has for its object to remedy or to reduce at least one of the drawbacks of the prior art, or at least provide a useful alternative to prior art. A first object of the invention is to provide an improved cable drum feeding tool for a vehicle with a lifting device, such as an excavator, a crane, a wheel loader, a forklift, etcetera. In particular, the object is to provide such tool for use field in conditions, such as the conditions of a construction site that reduces involved personnel and safety risks in the feeding operation. A second object of the invention is to provide a tool that facilitates switching easily and quickly between different cable drums, in particular allowing the operator to switch between different configurations of cable drums without leaving the operator cabin of the vehicle. A third object of the invention is to provide a tool with improved flexibility for use in related operations, such as moving objects, etcetera.

These object is achieved by means of a cable drum feeding tool according to claim 1. The tool comprises

- a primary gripper arm arrangement comprising a primary first gripper arm and a primary second gripper arm extending parallel and spaced apart from each other by means of a spacing, and a connection element connecting the primary first gripper arm and the primary second gripper arm,
- a primary gripper arm mechanism for moving at least one of the primary first gripper arm and the primary second gripper arm towards and away from the other of the primary gripper arms, and
- a rotation mechanism comprising a respective pivot at the primary first gripper arm and the primary second gripper arm adapted to engage with respective flanges of a cable drum. The tool is characterized in that it comprises an attachment arrangement for releasably attaching the tool to said lifting device of the vehicle.

The attachment arrangement enables the tools to be connected and disconnected from lifting devices of various construction vehicles, such as an excavator, a crane, a wheel loader, a forklift, etcetera. The attachment arrangement is preferably provided to fit with known standards for connection to the mentioned construction vehicles. Accordingly, the invention provides a cable drum feeding tool with improved flexibility to be use in field conditions with various constructions vehicles.

According to an embodiment of the invention, the tool comprises means for connection of actuation means for the primary gripper arm mechanism. The actuation means is for example one of hydraulic, pneumatic and electric actuation means for the tool. Preferably, the means for connection of the actuation means is provided according to standard connections to the mentioned construction vehicles. Accordingly, the powering of the tool is preferably provided by means on the vehicle.

According to an embodiment of the invention, the primary first gripper arm and the primary second gripper arm are telescopically arranged in the connection element and the primary gripper arm mechanism comprises a first motor unit between the primary first gripper arm and the primary second gripper arm for displacing the primary gripper arms in respect to each other.

According to an embodiment of the invention, primary first gripper arm and the primary second gripper arm are rotatably arranged in the connection element and the primary gripper arm mechanism comprises a first motor unit between the primary first gripper arm and the primary second gripper arm for rotating the primary gripper arms towards and away from each other.

According to an embodiment of the invention, the primary gripper arm mechanism comprises a respective upper pivot at an end portion of the primary first gripper arm and at the primary second gripper arm for rotating the respective primary gripper arm toward the other of the primary gripper arms, and wherein the primary gripper arm mechanism further comprises a respective lower pivot for orienting the rotation mechanism directed towards each other during said rotation of the primary gripper arms.

According to an embodiment of the invention, the primary gripper arm mechanism further comprises a connection arm between the upper pivot and the lower pivot for setting the orientation of the rotation mechanism in dependency of the orientation of the respective primary gripper arms.

According to an embodiment of the invention, the first motor unit is one of a hydraulic motor, a pneumatic motor and an electric motor.

According to an embodiment of the invention, the pivots comprise a respective conical member adapted to engage with a wall section of an opening in the flange of cable drum and a respective plate member adapted to engage with the flanges of the cable drum, wherein the pivots further comprises a connection mechanism for moving the plate member between an disengaged position and an engaged position with the flange of the drum.

The pivots are arranged so that the conical member first contacts the wall section of the opening in the flange of the cable drum and the connection mechanism is configured, after contact of the conical member, to move the plate member from the disengaged position to the engaged position. The disengaged position relates to a position in which the plate member lacks contact or essential contact with the flange of the cable drum. Correspondingly, the engaged position relates to a position in which the plate member is in engagement with the flange of the cable drum. Accordingly, the tool is arranged so that the conical member first contacts the cable drum and thereafter the plate member is moved into contact with the flange of the cable drum. Thereby, it is assured that the pivots are centred in respect to the opening in the flanges of the cable drum and the cable drum is gripped in a manner that enables cable to be unwound from or wound to the cable drum. By means of the plate member a large frictional contact surface is provided between the contact member and the flanges of the drum.

According to an embodiment of the invention, the connection mechanism comprises a movable connection member adapted to be contacted by the conical member and transfer a force to the plate member that moves the plate member from the disengaged position and the engaged position.

According to an embodiment of the invention, the connection member comprises two or more connection arms comprising a first end portion adapted to be contacted by the conical member and a second end portion adapted to contact the plate member for transferring said force to the plate member. The connection arms interconnect the conical member and the plate member so that the plate member is adapted to be moved from the disengaged position to the engaged position in dependency of a contact of the conical member with the wall section of the opening of the cable drum.

According to an embodiment of the invention, the connection member comprises a respective connection arm pivot around which the connection arms rotates, and wherein the respective connection arm pivot is arranged with a play. The play is adapted to adjust to a non-perpendicular contact between the second end portion of the respective connection arm with the plate member.

According to an embodiment of the invention, the connection member comprises a respective first connection arm pivot and a second connection arm pivot, which first connection arm pivot is arranged closer to the plate member than the second connection arm pivot, and wherein said play is arranged at least on the first connection arm pivot.

According to an embodiment of the invention, the connection member comprises a plurality of interconnected hydraulic cylinders arranged so that at least one of the cylinders is adapted to be contacted by the conical member and two or more of the other cylinders are adapted to contact the plate member for transferring said force to the plate member.

According to an embodiment of the invention, the connection member comprises a single hydraulic cylinder comprising a contact member adapted to be contacted by the conical member and a ring shaped piston head, which contact member and piston head are in hydraulic connection so that the force from the conical member is transferred to the plate member. The embodiment provides a configuration of the tool that enables a single hydraulic cylinder to be used for moving the plate member from the disengaged state to the engaged state.

According to an embodiment of the invention, the conical member comprises a first tooth rack, the plate member comprises a second tooth rack and the connection member comprises a gear wheel adapted to engage with the first tooth rack and the second tooth rack so that the force from the conical member is transferred to the plate member. The embodiment provides a configuration of the tool that enables tooth racks and gear wheel to be used for moving the plate member from the disengaged state to the engaged state.

According to an embodiment of the invention, the connection mechanism comprises a biasing member adapted to act on the plate member with a force that moves the plate member from the engaged position to the disengaged position. By means of the biasing member, the plate member is moved from the engaged position to the disengaged position when the pivot has been moved away from the flange of the cable drum so that the contact of the conical member with the wall section of the opening of the cable drum has been removed. The biasing member is for example an elastic member, such as a spring.

According to an embodiment of the invention, plate member comprises one or more friction pads adapted to contact the flanges of the drum for improving the contact between the tool and the drum. According to an alternative embodiment, the plate member comprises a disc of a material providing high friction when contacting the flange of the cable drum.

According to an embodiment of the invention, the connection member comprises protrusions and the plate member comprises corresponding grooves adapted to receive the protrusions when the plate member is in the engaged position. By means the protrusions of the connection member and the grooves of the plate member, a firm connection is established between the connection member and the plate member when the connection member is in the engaged position. Alternatively, the connection member comprises grooves and the plate member comprises protrusions arranged so that the grooves are adapted to receive the protrusions when the plate member is in the engaged position.

According to an embodiment of the invention, the respective conical member comprises a cone over two points. By means of the cone over two points, the cone can firmly engage with openings of various diameters in the drum.

Thereby, the invention allows the operator to switch between different configurations of cable drums without leaving the operator cabin of the vehicle.

In above embodiments of the invention, it shall be understood that the connection mechanism may be applied to other applications independently of the tool, where a connection is to be established to a flange or a wall comprising an opening, in particular openings of various sizes.

According to an embodiment of the invention, the tool is connected to other elements than the cable drum, such as a winch drum, a brush, a road roller drum or other elements configured to be rotated.

According to an embodiment of the invention, the rotation mechanism comprises a second motor unit controllably acting on at least one of the pivots for setting the pivot into rotation. The second motor enables cable to be automatically unwound from or wound to the cable drum by an operator. It shall be understood that the second motor to some extent may be controlled to also act as a brake unit for the rotation of the cable drum.

According to an embodiment of the invention, the second motor unit is one of a hydraulic motor, a pneumatic motor and an electric motor.

According to an embodiment of the invention, the rotation mechanism comprises a brake unit controllably acting on at least one of the pivots for reducing a speed of rotation of the pivot. The brake unit improves the control of unwinding or winding cable from/to the cable drum by the operator. The tool may be arranged comprising a brake unit but without a second motor unit for setting the pivots in rotation in that cable can be unwound from the cable drum by moving the vehicle and thereby setting the cable drum into rotation.

According to an embodiment of the invention, the tool comprises a secondary gripper arm arrangement comprising a secondary first gripper arm and a secondary second gripper arm rotatable arranged at an end portion of the primary first gripper arm and primary second gripper arm towards and away from each other by means of a respective further pivot.

According to an embodiment of the invention, the secondary first griper arm and the secondary second gripper arm are rotatably arranged between a first position, in which the secondary first gripper arm and secondary second gripper arm are extending into the spacing between the primary first gripper arm and primary second gripper arm, and a second position in which the secondary first gripper arm and secondary second gripper arm are extending away from the spacing between the primary first gripper arm and primary second gripper arm.

The secondary gripper arms are arranged on locations separate from the pivots for the rotation of the drum. By means of the secondary gripper arms, the tool can quickly alternate between cable feeding operation and picking and moving objects. Accordingly, the tool with the gripper arms provides an improved flexibility in use of the tool of the invention.

BRIEF DESCRIPTION OF DRAWINGS

In the following examples of preferred embodiments illustrated in the accompanying drawings are described, wherein:

FIG. 9 discloses the tool in engagement with a cable drum and in an operation feeding cable by means of a vehicle.

DETAILED DESCRIPTION

Figure 1:
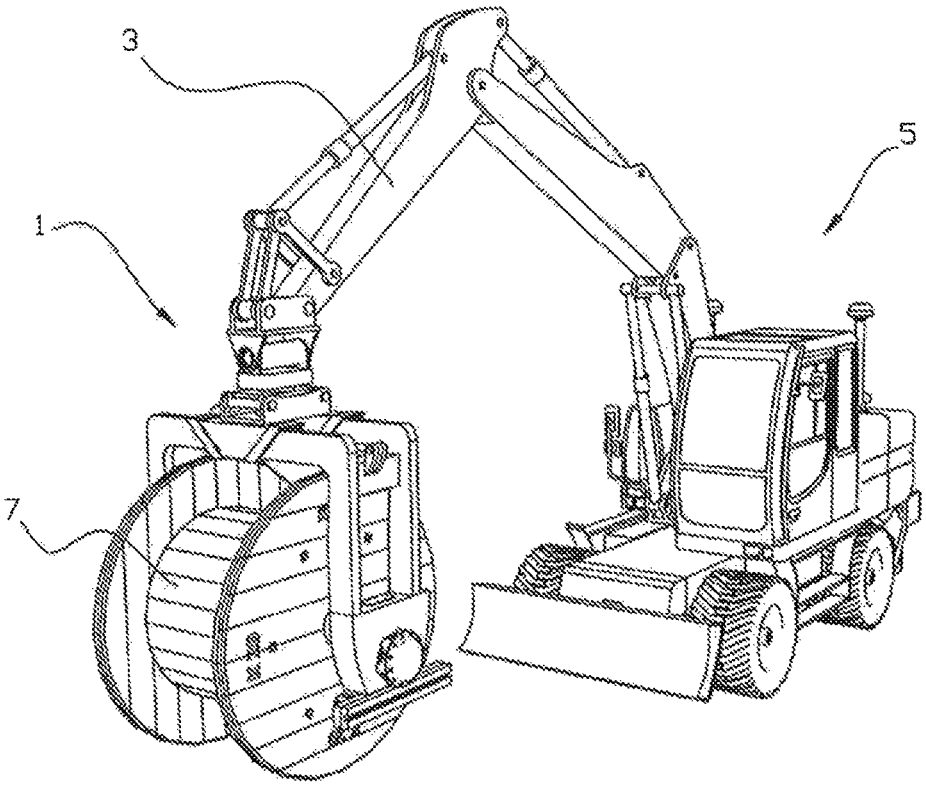
FIG. 1 discloses a cable drum feeding tool according to an embodiment of the invention, which tool is connected to lifting device of a vehicle.

In FIG. 1 a cable drum feeding tool 1 according to an embodiment of the invention is disclosed. The tool 1 is connected to a lifting device 3 of a vehicle 5. In the disclosed example, the tool 1 is connected to an excavator and holds a cable drum 7. However it shall be understood that other vehicles may be used to lift and operate the tool 1, such as a crane, a wheel loader, a forklift, etcetera.

Figure 2:
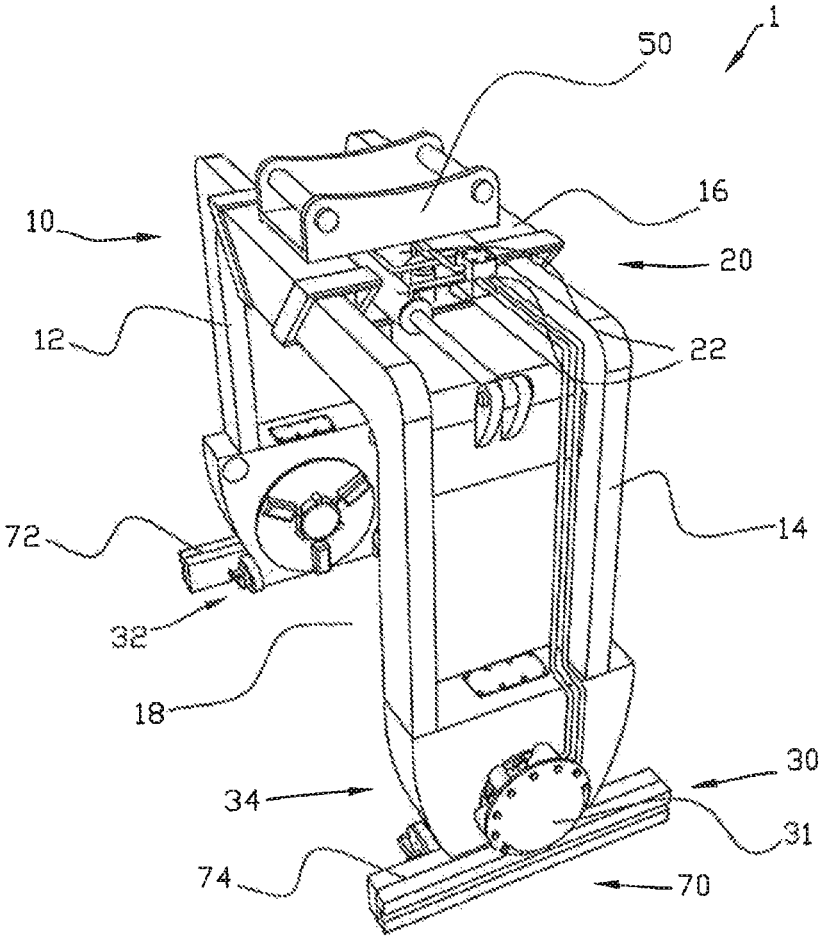
FIG. 2 discloses the cable drum feeding tool according to a first embodiment of the invention.
Figure 3:
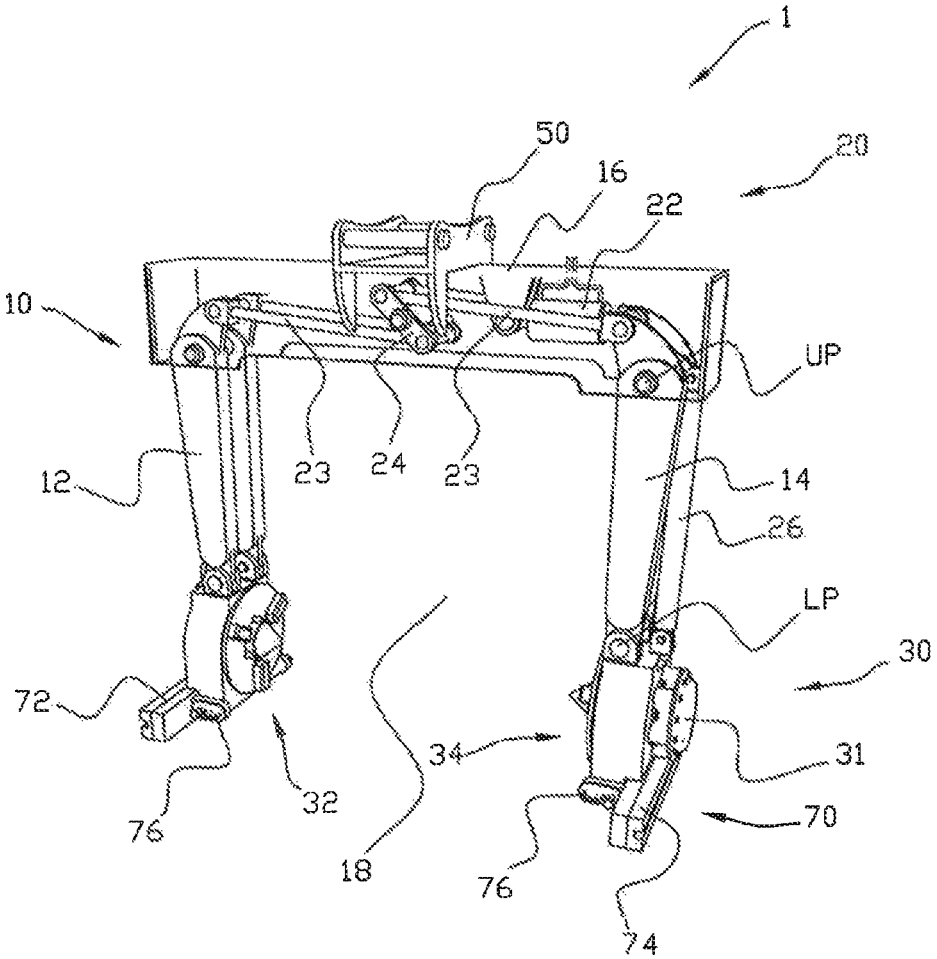
FIG. 3 discloses the cable drum feeding tool according to a second embodiment of the invention.

In FIG. 2 and FIG. 3 the tool 1 according to a first embodiment respectively a second embodiment of the invention are disclosed in further details. The tool 1 comprises a primary gripper arm arrangement 10 comprising a primary first gripper arm 12, a primary second gripper arm 14 and a connection element 16 connecting the primary first gripper arm 12 and the primary second gripper arm 14. The primary first gripper arm 12 and primary second gripper arm 14 are arranged extending in parallel or essentially in parallel and are spaced apart from each other by means of a spacing 18.

The tool 1 further comprises a primary gripper arm mechanism 20 for moving at least one of the primary first gripper arm 12 and the primary second gripper arm 14 towards and away from the each other, see FIGS. 2, and 3. For the purpose of illustration the mechanism 20 is made visible. However, it shall be understood that the primary gripper arm mechanism 20 may be arranged covered within a casing.

With reference to FIG. 2, the primary gripper arm mechanism 20 comprises a first motor unit 22. In the disclosed embodiment, primary gripper arm mechanism 20 comprises a respective first motor unit 22 connected to the respective primary gripper arms 12, 14. The first motor unit 22 is adapted to displace the primary gripper arms 12, 14 towards and away from each other without rotation, thereby regulating the extent of the spacing 18. The first motor unit 22 is for example a hydraulic cylinder.

The tool 1 further comprises a rotation mechanism 30 comprising respective pivots 32, 34 at the primary first gripper arm 12 and the primary second gripper arm 14. The first pivot 32 and second pivot 34 are adapted to engage with respective flanges of the cable drum 7. Thereby, the drum 7 is gripped rotatably by the tool 1 and enabling cable to be fed from the cable drum 7 while the drum 7 is held elevated from the ground by the lifting device 3 of the vehicle 5.

With reference to FIG. 3, the primary gripper arm mechanism 20 comprises a first motor unit 22, an upper pivot UP and a lower pivot LP at the respective primary gripper arm 12, 14. The first motor unit 22 is arranged so that is acts on both the primary first gripper arm 12 and the primary second gripper arm 14 by means of a rotational arm arrangement comprising two arms 23 connected to opposite ends of a pivot arm 24 at the connection element 16. The primary gripper arm mechanism 20 further comprises a connection arm 26 between the upper pivot UP and the lower pivot LP for setting the orientation of the rotation mechanism 30 in dependency of the orientation of the respective primary gripper arms 12, 14.

With reference to FIG. 4-7, the rotation mechanism 30 is disclosed in further details. The rotation mechanism 30 comprises a respective contact member adapted to engage with the flanges of the drum 7. The contact member comprises a plate member 36 adapted to engage with the flanges of the drum 7. The plate member 36 is provided with friction pads 38 adapted to contact the flanges of the drum 7 for improving the contact between the tool 1 and the drum 7. In the disclosed embodiment, the plate member 36 comprises three friction pads 38. In an alternative embodiment, the plate member 36 comprises a single disc of a material providing high friction when contacting the flange of the cable drum 7.

The pivot 32, 34 further comprises a connection arrangement comprising a respective conical member 40 adapted to engage with a wall section of an opening of the drum 7 and a connection mechanism 41 for moving the plate member 36 between an disengaged position and an engaged position with the flange of the drum 7 in dependency of a contact of the conical member 40 with the wall section of the opening of the drum 7. The connection mechanism 41 comprises a movable connection member 41*a* adapted to be contacted by the conical member 40 and transfer a force to the plate member 36 that moves the plate member 36 from the disengaged position and the engaged position.

Figure 4:
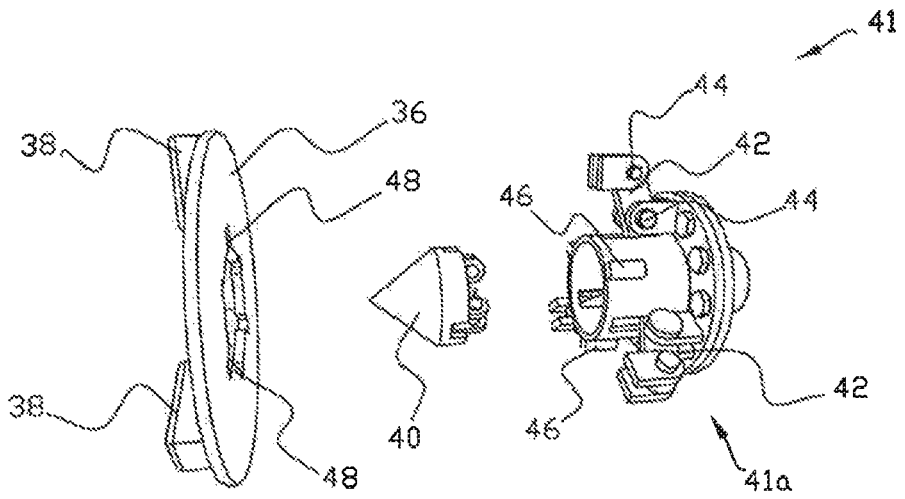
FIG. 4 discloses a connection arrangement of the tool according to a third embodiment of the invention.

In FIG. 4 a third embodiment of the invention relating to the connection mechanism 41 is disclosed. The connection member 41*a* comprises a plurality of connection arms 42 comprising a first end portion adapted to be contacted by the conical member 40 and a second end portion adapted to contact the plate member 36 for transferring said force to the plate member 36. Each connection member 41*a* comprise a respective connection arm pivot 44 around which the connection arms 42 may rotate. Preferably, the respective connection arm pivot 44 is arranged with a play, such as by means axis rotatable in of an elliptical opening. By means of the play a perpendicular arrangement of the connections arms 42 in relation to the plate member 36 is assured.

In FIG. 4, the connection mechanism 41 is arranged with three connection arms 42 equidistant distributed from each other. It shall be understood that any plurality of connection arms 42 may be applied for the connection mechanism 41.

Figure 5:
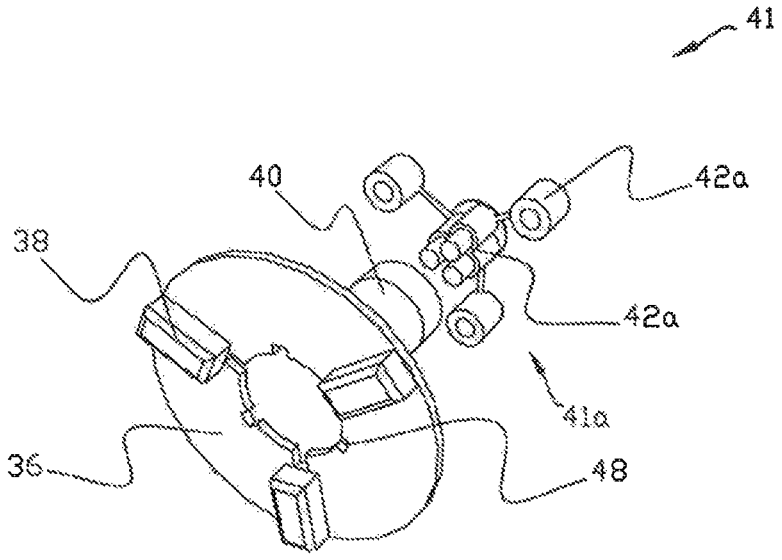
FIG. 5 discloses a connection arrangement of the tool according to a fourth embodiment of the invention.

In FIG. 5 a fourth embodiment of the invention relating to the connection mechanism 41 is disclosed. The connection member 41*a* comprises a plurality of interconnected hydraulic cylinders 42*a* arranged so that at least one of the cylinders 42*a* is adapted to be contacted by the conical member 40 and two or more of the other cylinders 42*a* are adapted to contact the plate member 36 for transferring said force to the plate member 36. In the disclosed embodiment, a group of three centrally positioned cylinders 42*a* are arranged to be contacted by the conical member 40 and three cylinders 42*a* arranged distributed around the centrally positioned group of cylinders 42*a* and are hydraulically connected with the central group of cylinders 42*a* so that they transfer the force from the conical member 40 to the plate member 36. The interconnection between the cylinders 42*a* relates to hydraulic pipes connecting the cylinders 42*a*. It shall be understood that other plurality of hydraulic cylinders 42*a* may be applied for the connection mechanism 41, such as pneumatic cylinders.

Figure 6:
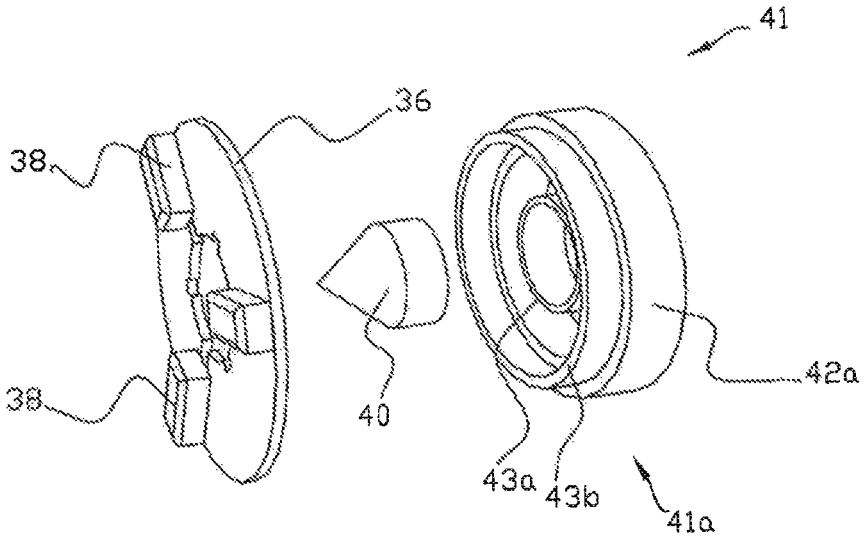
FIG. 6 discloses a connection arrangement of the tool according to a fifth embodiment of the invention.

In FIG. 6 a connection arrangement of the tool 1 according to a fifth embodiment of the invention is disclosed. The connection member 41*a* comprises a single hydraulic cylinder 42*a* comprising a contact member 43*a* adapted to be contacted by the conical member 40 and a ring shaped piston head 43*b*, which contact member 43*a* and piston head 43*b* are in hydraulic connection so that the force from the conical member 40 is transferred to the plate member 36. In the disclosed embodiment the contact member 43*a* comprises an inner ring adapted to be contacted by the conical member 40 and the piston head 43*b* comprises an outer ring, which inner ring member and outer ring member are concentrically arranged.

Figure 7:
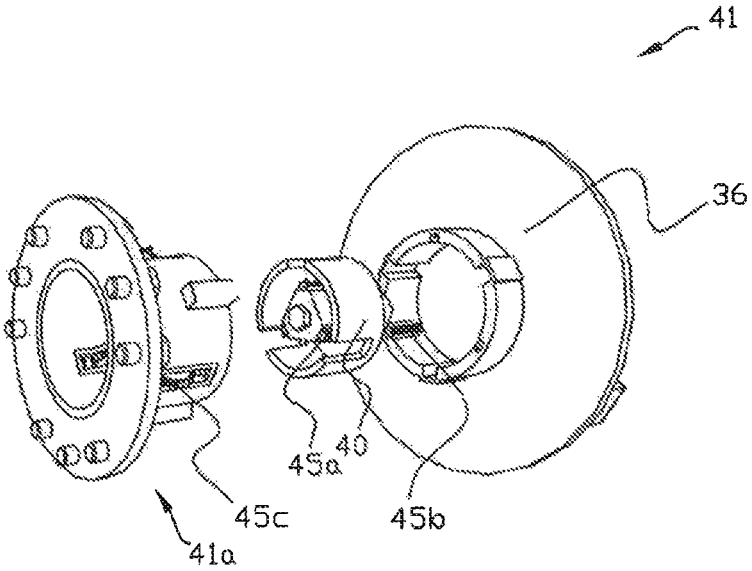
FIG. 7 discloses a connection arrangement of the tool according to a sixth embodiment of the invention.

In FIG. 7 a connection arrangement of the tool according to a sixth embodiment of the invention is disclosed. The conical member 40 comprises a first tooth rack 45*a*, the plate member 36 comprises a second tooth rack 45*b* arranged on a protruding part of the plate member 36, and the connection member 41*a* comprises a gear wheel 45*c* adapted to engage with the first tooth rack 45*a* and the second tooth rack 45*b* so that the force from the conical member 40 is transferred to the plate member 36. The tool 1 is arranged so that the conical member 40 first contacts the cable drum 7 and thereafter the plate member 36 is moved into contact with the flange of the cable drum 7. Thereby, it is assured that the pivots 32, 34 are centred in respect to the opening in the flanges of the cable drum 7 and the cable drum 7 is gripped in a manner that enables cable to be unwound from or wound to the cable drum.

Preferably, the connection mechanism 41 comprises a biasing member adapted to act on the plate member 36 with a force that moves the plate member 36 from the engaged position and the disengaged position. The biasing member is for example an elastic member, such as an elastic spring.

The conical member 40 adapted to engage with a wall section in an opening of the flange of the cable drum 7. The conical member 40 is preferably a cone over two points, i.e. a conical member without truncations, which has the advantage that it provides an appropriate engagement with the wall section of openings of different diameters. Accordingly, the tool 1 of the invention enables handling of cables drums 7 with different openings.

In the disclosed embodiments, the connection member 41*a* further comprises protrusions 46 and the plate member 36 comprises corresponding grooves 48 adapted to receive the protrusions 46 when the plate member 36 is in the engaged position. Alternatively, the connection member 41*a* comprises grooves 48 and the plate member 36 comprises corresponding protrusions 46. In FIG. 4, connection member 41*a* comprises three protrusion 46 extending from a tubing with an opening adapted to receive the conical member 40 and the plate member 36 comprises correspondingly arranged grooves 48. It shall be understood that the connection mechanism 41 may be applied to other applications independently of the tool of the invention, where a connection is to be established to a flange or a wall comprising an opening, in particular openings of various sizes, thereby allowing the operator to switch between different configurations of cable drums 7 without leaving the operator cabin of the vehicle 5.

Preferably, the rotation mechanism 30 comprises a second motor unit 31 controllably acting on at least one of the pivots 32, 34 for setting the pivot 32, 34 into rotation. In FIGS. 2 and 3, the tool 1 comprises a single second motor unit 31 arranged at the second pivot 34. By means of the second motor unit 31, cable is adapted to be controllably fed from the drum 7 during operation of the tool 1. The second motor unit 31 is for example a hydraulic motor, a pneumatic motor or an electric motor. It shall be understood that a respective second motor unit may be arranged at both of the pivots 32, 34.

Preferably, the rotation mechanism 30 further comprises a brake unit controllably acting on at least one of the pivots 32, 34 for reducing a speed of rotation of the pivots 32, 34. The brake unit is not disclosed in the figures. By means of the brake unit, the feeding of cable from the drum 7 is adapted to be controllably stopped during operation of the tool 1. It shall be understood that a respective brake unit may be arranged at both the pivots 32, 34. Alternative, the second motor unit may be used as for breaking the rotation of the cable drum 7. Alternatively the tool 1 may be provided with a brake unit but lacking the second motor unit, in that the movement of vehicle 5 may be used for setting the cable drum 7 in rotation.

The tool 1 further comprises an attachment arrangement 50 for releasably attaching the tool 1 to said lifting device 3 of the vehicle 5. The attachment arrangement 50 enables the tools 1 to be connected and disconnected from lifting devices 3 of various construction vehicles 5. Preferably, the attachment arrangement 50 is arranged of known standards for connection to the intended construction vehicle 5. Accordingly, the invention provides a cable drum feeding tool 1 with improved flexibility to be use in field conditions with various constructions vehicles 5.

With reference to FIGS. 2 and 3, the tool 1 further comprises a secondary gripper arm arrangement 70 comprising a secondary first gripper arm 72 and secondary second gripper arm 74 rotatably arranged at an end portion of the primary first gripper arm 12 and primary second gripper arm 14 towards and away from each other by means of a respective further pivot 76. The secondary first griper arm 72 and the secondary second gripper arm 74 are rotatably arranged between a first position, in which the secondary first gripper arm 72 and the secondary second gripper arm 74 are extending into the spacing 18 between the primary first gripper arm 12 and primary second gripper arm 14, and a second position in which the secondary first gripper arm 72 and secondary second gripper arm 74 are extending away from the spacing 18 between the primary first gripper arm 12 and primary second gripper arm 14.

Figure 8:
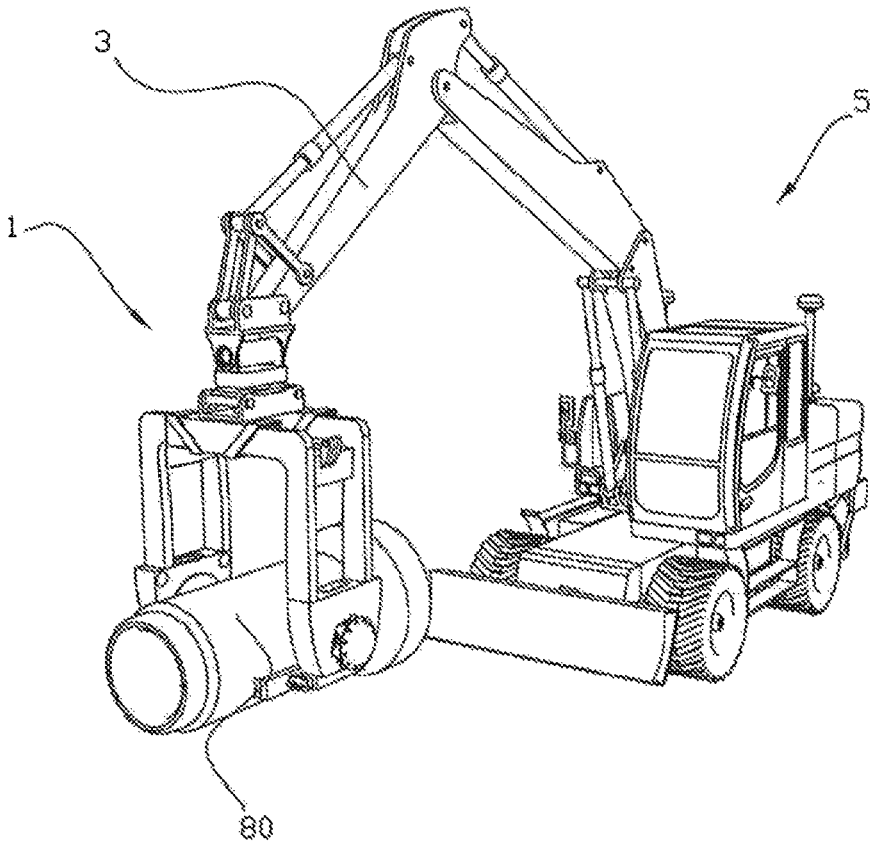
FIG. 8 discloses the tool in an operation picking and moving a pipe by means of a vehicle.
Figure 6:
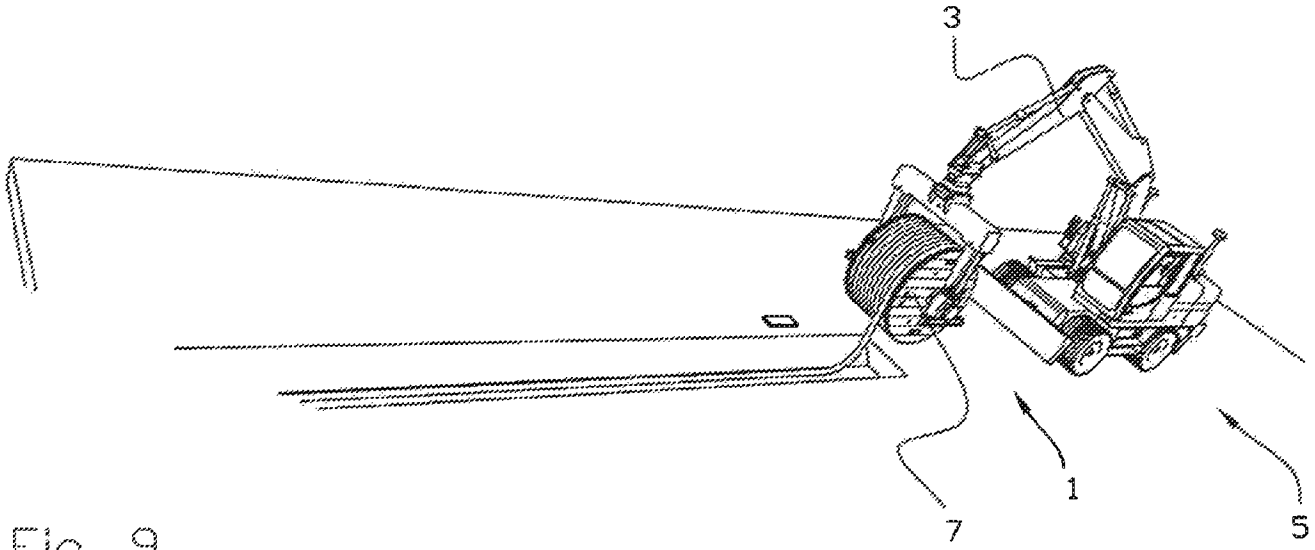

The secondary gripper arm arrangement 70 is used for gripping various objects, such as pipes, etcetera. Accordingly, the tool 1 of the invention enables alternating between operation of feeding cable and gripping and moving objects. Alternatively, the pivots 32, 34 may be used to grip objects without openings. FIG. 8 discloses the tool 1 in an operation picking and moving a pipe 80 by means of an excavator using the secondary gripper arm arrangement 70.

Figure 10:
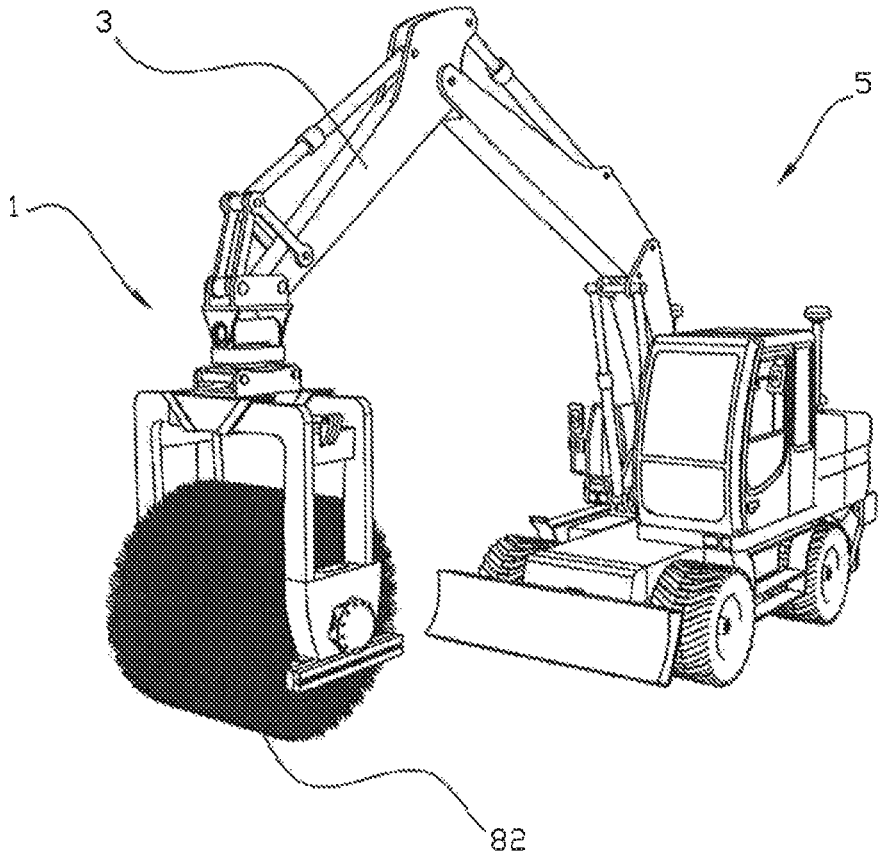
FIG. 10 discloses the tool in engagement with a brush and in an operation by means of a vehicle.

In FIG. 9 the tool 1 is discloses in engagement with a cable drum 7 and in an operation feeding cable by means of an excavator. It shall be understood that the tool 1 may also be used for other purposes, such as for connection and spinning of a brush 82, a winch drum or similar. In FIG. 10 the tool 1 is disclosed in engagement with a brush 82 and in an operation by means of an excavator.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage.

The invention claimed is:

1. A cable drum feeding tool for a vehicle with a lifting device, the tool comprising:

a primary gripper arm arrangement comprising a primary first gripper arm and a primary second gripper arm extending parallel and spaced apart from each other via a spacing, and a connection element connecting the primary first gripper arm and the primary second gripper arm, a primary gripper arm mechanism for moving at least one of the primary first gripper arm and the primary second gripper arm towards and away from the other of the primary gripper arms, and a rotation mechanism comprising a respective pivot at the primary first gripper arm and the primary second gripper arm adapted to engage with respective flanges of a cable drum, wherein the tool further comprises an attachment arrangement for releasably attaching the tool to said lifting device of the vehicle;

wherein the pivots comprises a respective conical member adapted to engage with a wall section of an opening in the flange of the cable drum and a respective plate member adapted to engage with the flanges of the cable drum, wherein the pivots further comprises a connection mechanism for moving the plate member between a disengaged position and an engaged position with the flange of the drum.

2. The tool according to claim 1, wherein the tool comprises means for connection of actuation means for the primary gripper arm mechanism.

3. The tool according to claim 1, wherein the primary first gripper arm and the primary second gripper arm are telescopically arranged in the connection element and the primary gripper arm mechanism comprises a first motor unit between the primary first gripper arm and the primary second gripper arm for displacing the primary gripper arms in respect to each other.

4. The tool according to claim 1, the primary first gripper arm and the primary second gripper arm are rotatable arranged in the connection element and the primary gripper arm mechanism comprises a first motor unit between the primary first gripper arm and the primary second gripper arm for rotating the primary gripper arms towards and away from each other.

5. The tool according to claim 4, wherein the primary gripper arm mechanism comprises a respective upper pivot at an end portion of the primary first gripper arm and at the primary second gripper arm for rotating the respective primary gripper arm toward the other of the primary gripper arms, and wherein the primary gripper arm mechanism further comprises a respective lower pivot for orienting the rotation mechanism directed towards each other during said rotation of the primary gripper arms.

6. The tool according to claim 5, wherein the primary gripper arm mechanism further comprises a connection arm between the upper pivot and the lower pivot for setting the orientation of the rotation mechanism in dependency of the orientation of the respective primary gripper arms.

7. The tool according to claim 1, wherein the connection mechanism comprises a movable connection member adapted to be contacted by the conical member and transfer a force to the plate member that moves the plate member from the disengaged position and the engaged position.

8. The tool according to claim 7, wherein the connection member comprises a single hydraulic cylinder comprising a contact member adapted to be contacted by the conical member and a ring shaped piston head, which contact member and piston head are in hydraulic connection so that the force from the conical member is transferred to the plate member.

9. The tool according to claim 7, wherein conical member comprises a first tooth rack, the plate member comprises a second tooth rack and the connection member comprises a gear wheel adapted to engage with the first tooth rack and the second tooth rack so that the force from the conical member is transferred to the plate member.

10. The tool according to claim 1, wherein the connection member comprises two or more connection arms comprising a first end portion adapted to be contacted by the conical member and a second end portion adapted to contact the plate member for transferring said force to the plate member.

11. The tool according to claim 1, wherein the connection member comprise a respective connection arm pivot around which the connection arms rotate.

12. The tool according to claim 1, wherein the connection member comprises a plurality of interconnected hydraulic cylinders arranged so that at least one of the cylinders is adapted to be contacted by the conical member and two or more of the other cylinders are adapted to contact the plate member for transferring said force to the plate member.

13. The tool according to claim 1, wherein the connection mechanism is configured to bias the plate member with a force that moves the plate member from the engaged position to the disengaged position.

14. The tool according to claim 1, wherein the plate member comprises one or more friction pads adapted to contact the flanges of the drum for improving the contact between the tool and the drum.

15. The tool according to claim 1, wherein the connection member comprises protrusions and the plate member comprises corresponding grooves adapted to receive the protrusions when the plate member is in the engaged position.

16. The tool according to claim 1, wherein the rotation mechanism comprises a second motor unit controllably acting on at least one of the pivots for setting the pivot into rotation.

17. The tool according to claim 1, wherein the rotation mechanism is configured to controllably act on at least one of the pivots for reducing a speed of rotation of the pivot.

18. A cable drum feeding tool for a vehicle with a lifting device, the tool comprising:

a primary gripper arm arrangement comprising a primary first gripper arm and a primary second gripper arm extending parallel and spaced apart from each other via a spacing, and a connection element connecting the primary first gripper arm and the primary second gripper arm, a primary gripper arm mechanism for moving at least one of the primary first gripper arm and the primary second gripper arm towards and away from the other of the primary gripper arms, and a rotation mechanism comprising a respective pivot at the primary first gripper arm and the primary second gripper arm adapted to engage with respective flanges of a cable drum, wherein the tool further comprises an attachment arrangement for releasably attaching the tool to said lifting device of the vehicle;

wherein the tool comprises a secondary gripper arm arrangement comprising a secondary first gripper arm and a secondary second gripper arm rotatably arranged at an end portion of the primary first gripper arm and primary second gripper arm towards and away from each other by means of a respective further pivot.

19. The tool according to claim 18, wherein the secondary first griper arm and the secondary second gripper arm are rotatably arranged between a first position, in which the secondary first gripper arm and secondary second gripper arm are extending into the spacing between the primary first gripper arm and primary second gripper arm, and a second position in which the secondary first gripper arm and secondary second gripper arm are extending away from the spacing between the primary first gripper arm and primary second gripper arm.

* * * * *